US008943640B2

(12) United States Patent
Saccoccio et al.

(10) Patent No.: US 8,943,640 B2
(45) **Date of Patent: *Feb. 3, 2015**

(54) SWIMMING POOL BRUSH

(71) Applicant: Asia Connection LLC, New York, NY (US)

(72) Inventors: Mitch Saccoccio, Clarksville, VA (US); Jonathan Bonelli, New York, NY (US)

(73) Assignee: Asia Connection LLC, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/864,775

(22) Filed: Apr. 17, 2013

(65) Prior Publication Data

US 2013/0283554 A1 Oct. 31, 2013

Related U.S. Application Data

(60) Provisional application No. 61/639,253, filed on Apr. 27, 2012.

(51) Int. Cl.

| | |
|---|---|
| ***E04H 4/16*** | (2006.01) |
| ***A46B 9/02*** | (2006.01) |
| ***A46B 5/00*** | (2006.01) |

(52) U.S. Cl.

CPC ..... *A46B 9/02* (2013.01); *A46B 5/0095* (2013.01); *A46B 9/026* (2013.01); *E04H 4/1609* (2013.01)

USPC ..... 15/160; 15/1.7

(58) Field of Classification Search

None

See application file for complete search history.

(56) References Cited

U.S. PATENT DOCUMENTS

| | | | | |
|---|---|---|---|---|
| 2,083,134 | A | 6/1937 | Wood | |
| 3,273,187 | A | 9/1966 | Williams | |
| 3,296,643 | A | 1/1967 | Fortune | |
| 4,176,419 | A | 12/1979 | MacDonald | |
| D257,521 | S | 11/1980 | Piero | |
| 4,479,277 | A | 10/1984 | Gilman et al. | |
| 4,637,087 | A | 1/1987 | Feinberg | |
| 4,703,535 | A * | 11/1987 | Nehls | 15/1.7 |
| 4,733,427 | A | 3/1988 | Conrad | |
| 4,783,868 | A | 11/1988 | O'Callaghan | |
| 4,831,678 | A * | 5/1989 | Dietsche | 15/176.4 |
| D351,948 | S | 11/1994 | Getchell | |
| 5,487,397 | A | 1/1996 | Bean | |
| 6,148,466 | A * | 11/2000 | Smitelli et al. | 15/160 |
| 8,528,146 | B1 * | 9/2013 | Abrahamson | 15/160 |
| 8,707,503 | B2 * | 4/2014 | Saccoccio et al. | 15/160 |

* cited by examiner

*Primary Examiner* — Monica Carter
*Assistant Examiner* — Stephanie Berry
(74) *Attorney, Agent, or Firm* — Dilworth & Barrese, LLP

(57) ABSTRACT

A pool brush includes a handle receiver; and a brush head attached to the handle receiver, the brush head having a body and a plurality of bristles extending from said body. The body includes a cylindrical portion having rounded top, bottom, front and rear sides, and opposite end portions, and the plurality of bristles includes bristles radially extending 360 degrees around the cylindrical portion of the body and from the end portions. The plurality of bristles includes a plurality of bundles of relatively longer bristles and a plurality of bundles of relatively shorter bristles, wherein the bundles of relatively longer bristles are in arrays in an alternating arrangement with arrays of the bundles of shorter bristles.

18 Claims, 3 Drawing Sheets

SWIMMING POOL BRUSH

CROSS REFERENCE TO RELATED APPLICATIONS

The present application claims priority to U.S. Provisional application No. 61/639,253 filed Apr. 27, 2012, which is herein incorporated by reference.

BACKGROUND

1. Field of the Invention

This invention relates to swimming pool cleaning devices, and in particular to a cylindrical swimming pool brush head having rounded ends with bristles perpendicularly mounted along the rounded sides so that hard to reach narrow angled areas such as corners, stairs, and seat areas can be cleaned.

2. Background of the Art

Swimming pool brushes have been around for many years. Most traditional brushes have an elongated handle connected to a brush head. See for example U.S. Pat. No. D. 351,948 to Getchell; U.S. Pat. No. 3,296,643 to Fortune; U.S. Pat. No. 4,637,087 to Feinberg; U.S. Pat. No. 4,703,535 to Nehls; U.S. Pat. No. 4,733,427 to Conrad; U.S. Pat. No. 4,783,868 to O'Callaghan; and U.S. Pat. No. 5,487,397 to Bean. However, these references are limited to having bristles oriented generally downward, and are not capable of adequately cleaning all corners where walls and floors come together, areas where different planar walls intersect, edge areas where walls meet floors, and around stairs, seats and the like.

U.S. Pat. No. Des. 257,521 to Piero; and U.S. Pat. No. 4,176,419 to MacDonald each describe other pool brushes where the bristles are only oriented about part of the perimeter edges of the brush head, and are also not capable of adequately cleaning all corners where walls and floors come together, areas where different planar walls intersect, edge areas where walls meet floors, around stairs, seats and the like.

U.S. Pat. No. 2,083,134 to Wood shows a complex brush for "cleaning vats" having separately positioned bristle heads attached to two parallel brush heads, and also would not appear to be capable of adequately cleaning all corners where walls and floors come together, areas where different planar walls intersect, edge areas where walls meet floors, around stairs, seats and the like.

U.S. Pat. No. 3,273,187 to Williams shows a triangular "vacuum cleaner head" of bristles that would be difficult to maneuver and use for adequately cleaning all corners where walls and floors come together, areas where different planar walls intersect, edge areas where walls meet floors, around stairs, seats and the like.

U.S. Pat. No. 4,479,277 to Gilman et al. describes a scrub pad brush with downwardly oriented bristles and one side edge having rounded edge bristles. However, Gilman requires a handle parallel to a small rectangular pad brush head with only rounded bristles on one side edge and does not describe any application for cleaning pools and can not be used for adequately cleaning all corners where walls and floors come together, areas where different planar walls intersect, edge areas where walls meet floors, around stairs, seats and the like.

U.S. Pat. No. 6,148,466 to Smitelli, III et al. discloses a pool brush having a cylindrical body with semi-spherical rounded ends. The bristles, when the head is seen in cross section, extend about 280 degrees around the body with the body having a flat portion in top.

SUMMARY

A pool brush is provided herein which comprises (a) a handle receiver; and (b) a brush head attached to the handle receiver, the brush head having a body and a plurality of bristles extending from said body, wherein said body includes a cylindrical portion having rounded top, bottom, front and rear sides, and opposite end portions, and said plurality of bristles includes bristles radially extending 360 degrees around the cylindrical portion of the body and from the end portions, wherein the plurality of bristles includes a plurality of bundles of relatively longer bristles and a plurality of bundles of relatively shorter bristles, wherein at least some of the bundles of relatively longer bristles are in arrays in an alternating arrangement with arrays of the bundles of shorter bristles.

The present invention advantageously provides a simple, efficient pool brush for easily cleaning all corners where walls and floors come together, areas where different planar walls intersect, edge areas where walls meet floors, around stairs, seats and the like, while simultaneously being able to clean all other surface areas of a pool. Furthermore, the pool brush herein can clean the underside of pool steps without turning the brush over, which is a significant advantage.

BRIEF DESCRIPTION OF THE DRAWINGS

Various embodiments are described below with reference to the drawings wherein.

DETAILED DESCRIPTION OF PREFERRED EMBODIMENT(S)

It will be understood that any numerical range recited herein is intended to include all sub-ranges within that range.

It will be further understood that any compound, material or substance which is expressly or implicitly disclosed in the specification and/or recited in a claim as belonging to a group of structurally, compositionally and/or functionally related compounds, materials or substances includes individual representatives of the group and all combinations thereof.

A preferred embodiment of the pool brush includes a handle receiver configured to receive an elongated handle, and a brush head having a cylindrical body with rounded front, bottom and rear sides. The cylindrical body having opposite semi-spherical rounded ends and a mid-portion is perpendicularly connected to the elongated handle, where the handle is longer than the brush head.

The bristles are perpendicularly mounted to the front, bottom and rear rounded surface sides, as well as to the semi-spherical rounded ends of the brush head. A cross-sectional view of the cylindrical brush head shows the bristles extending outward in a 360 degree range. Mounting the bristles on all the rounded surfaces of the brush head allows the pool brush to be able to clean all interior and exterior pool surface areas as well as where walls intersect, walls meet floors, around stairs, and around pool seats. The bristles on the top surface of the brush head advantageously allow the brush to clean the underside of the pool steps without turning the brush over. The bristles can be made of natural or synthetic fibers, particularly nylon, polypropylene, polybutylene terephthalate and the like, and, as described below, can be of different lengths and hardness.

Figure 1:
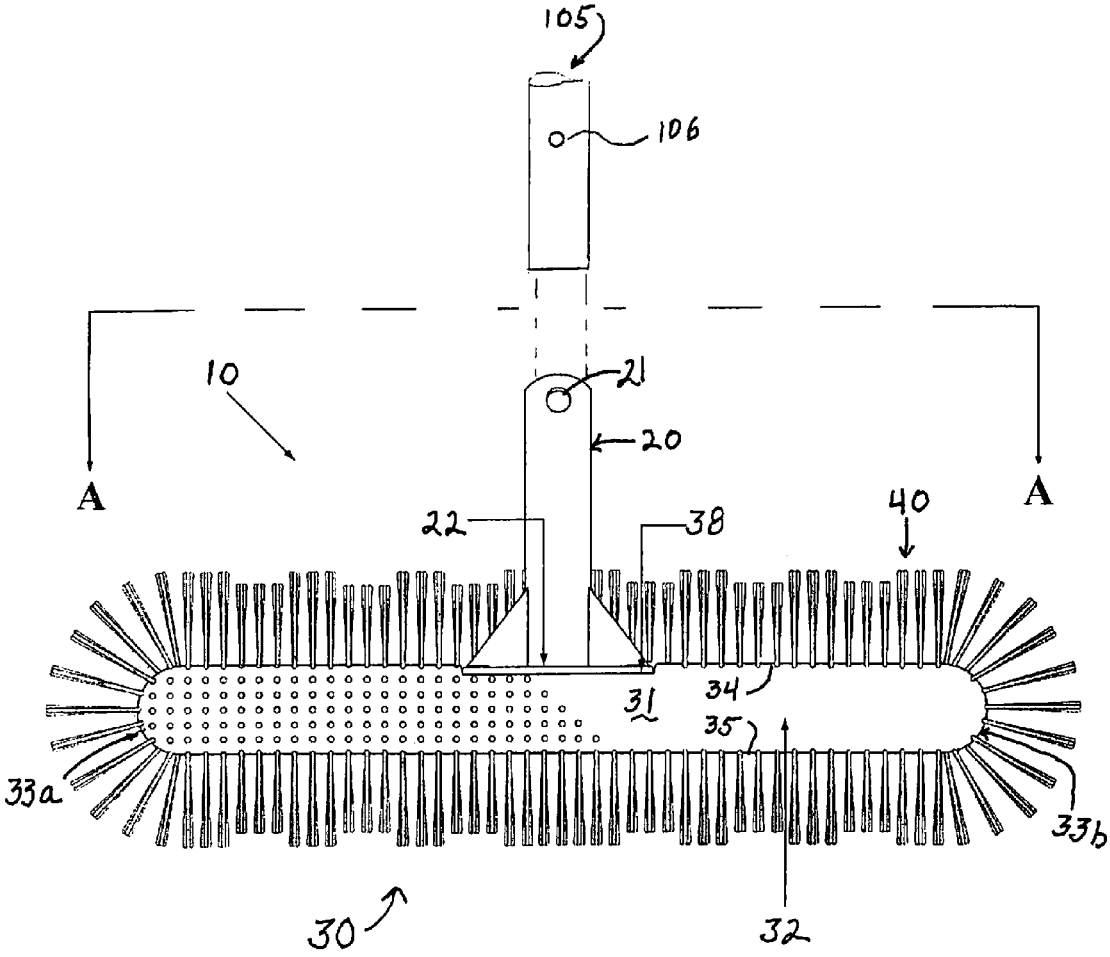
FIG. 1 is a front elevational view of the pool brush of the invention.
Figure 2:
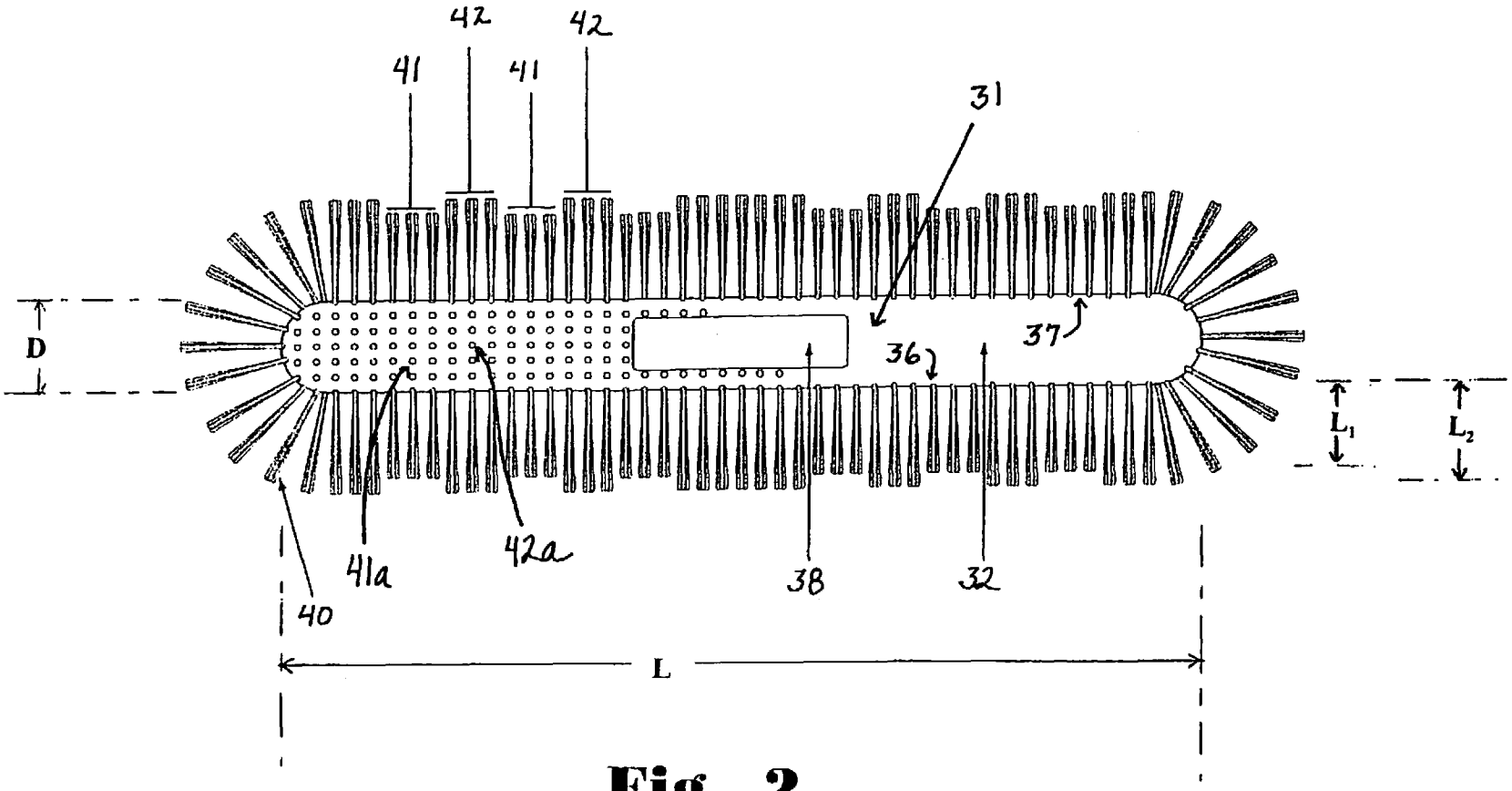
FIG. 2 is a top view of the brush head of FIG. 1 along lines A-A.
Figure 3:
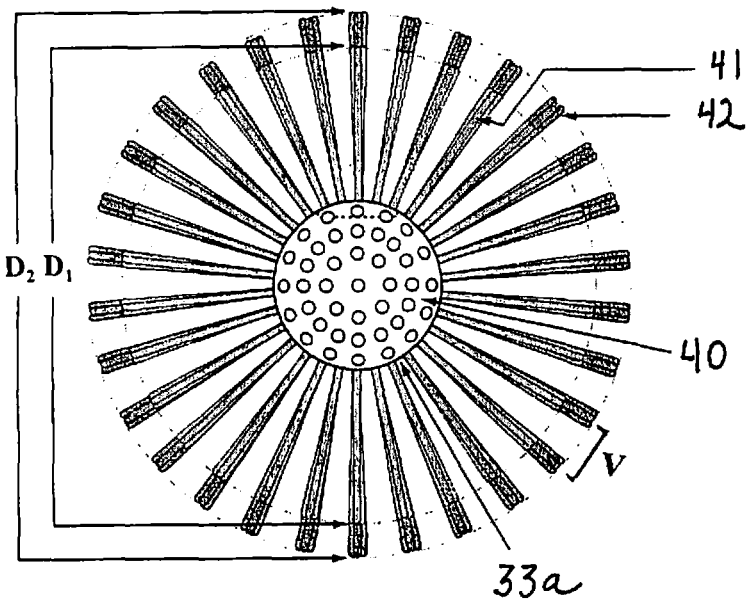
FIG. 3 is an end view of the brush head of FIG. 2.

FIG. 1 is a front elevational view of the brush 10 of the subject invention. FIG. 2 is a top view of the brush head of FIG. 1 taken along line A-A. FIG. 3 is an end view of the brush head of FIG. 2.

Referring to FIGS. 1-3, brush 10 includes a longitudinal handle receiver 20 having a generally rectangular bottom plate 22 which can be removably engaged in a correspondingly shaped recess 38 in the mid-portion of the top 34 of the body 31 of brush head 30 by conventional fasteners. Handle receiver 20 preferably comprises a metal or plastic tubular member having an axial channel to receive an elongated handle 105. Handle 105 can be fabricated from metal (e.g., aluminum, stainless steel, etc.) or plastic (polyvinyl chloride, polycarbonate, etc.). In an embodiment handle 105 includes a resilient button 106 configured to snap into opening 21 in the tubular member of handle receiver 20 when the handle is removably engaged therewith. Alternatively, opening 21 in the side of the tubular member is configured to receive a screw or other fastener to secure the engagement of the handle 105 with the handle receiver 20.

Body 31 has a middle cylindrical portion 32, having a rounded top side 34, bottom side 35 and front and rear sides 36 and 37, respectively. Body 32 further has opposite end portions 33*a* and 33*b*. Recess 38 in the top 34 of the body 31 preferably has a depth equal to the thickness of plate 22 such that the top surface of plate 22 is flush with the exterior surface of the body 31. Body 31 can have any length and diameter suitable for the purposes described herein. In an embodiment, body 31 can have a length L ranging from 6 inches to 30 inches, preferably 10 to 18 inches. Typically, body 31 can have a diameter D ranging from approximately 1 to 3 inches. Opposite ends 33*a* and 33*b* can be hemispherical, conical, or otherwise rounded portions. Body 31 can be formed from injection molded plastic, metal such as aluminum or stainless steel, and the like.

Extending radially from the central cylindrical portion 32 of the body 31, bristles 40 can comprise alternating arrays of bundles of short bristles 41 and bundles of long bristles 42, said arrays extending circumferentially around the cylindrical portion 32 and each array 41 and 42 including at least one, and preferably 2 to 4 circumferential rows 41*a* and 42*a*, respectively, of bristles. The short bristles 41 can extend for a length $L_1$ of from about ½ to about 3½ inches. The long bristles 42 can extend for a length $L_2$ of from about ¾ to about 3¾ inches, wherein $L_2$ is greater than $L_1$ such that the ratio $L_2/L_1$ ranges from about 1.05 to about 1.5 and more preferably from about 1.1 to 1.3. It should be understood that the dimensions and ratios given above are for illustrative purposes only. Dimensions, quantities and ratios outside of the given ranges can be employed whenever appropriate.

The outer diameter of the arrays of the short bristles 41 is depicted in FIG. 3 as $D_1$ wherein $D_1=2L_1+D$. The outer diameter of the arrays of the long bristles 42 is depicted in FIG. 3 as $D_2$ wherein $D_2=2L_2+D$.

Across all adjacent rounded surfaces, the bundles of bristles in an array can be in an angular orientation with respect to each other. In particular the bundles of bristles can be oriented at an angle V (FIG. 3) with respect to adjacent bundles, wherein angle V can be any angle suitable for the purposes described herein. In an embodiment, V can range from about 1 to 30 degrees, preferably 5 to 20 degrees and more preferably 5 to 15 degrees. Bristles 40 also extend radially outward from the end portions 33*a* and 33*b* and can be long bristles or short bristles.

Moreover, bristles 40 can have different densities so as to be alternatingly hard and soft bristles. For example, the bundles of long bristles 42 can comprise relatively soft bristles and the bundles of short bristles 41 can be relatively harder (or stiffer) bristles, or vice versa. The difference in hardness of the bundles can be achieved by increasing the number of bristles in a bundle. Alternatively, the difference in hardness can be achieved by using different materials to fabricate the bristles of the different bundles. For example, the softer bristles can be fabricated from nylon while the stiffer bristles can be fabricated from polypropylene.

The pool brush of the invention provides 360 degree cleaning and can clean around, the tops and undersides of steps, the surfaces of walls and floors, corners, or virtually anywhere in or around a swimming pool or spa.

While the above description contains many specifics, these specifics should not be construed as limitations of the invention, but merely as exemplifications of preferred embodiments thereof Those skilled in the art will envision many other embodiments within the scope and spirit of the invention as defined by the claims appended hereto.

What is claimed is:

1. A pool brush which comprises:

a) a handle receiver; and b) a brush head attached to the handle receiver, the brush head having a body and a plurality of bristles extending from said body, wherein said body includes a cylindrical portion having rounded top, bottom, front and rear sides, and opposite end portions, and said plurality of bristles includes bristles radially extending 360 degrees around a major portion of the cylindrical portion of the body and from the end portions as viewed in an end view, wherein the plurality of bristles includes a plurality of bundles of relatively longer bristles and a plurality of bundles of relatively shorter bristles, wherein at least some of the bundles of relatively longer bristles are in arrays in an alternating arrangement with arrays of the bundles of shorter bristles.

2. The pool brush of claim 1 wherein the handle receiver comprises a tubular member and a bottom plate attached to the tubular member.

3. The pool brush of claim 2 further comprising an elongated handle which is engageable with an axial channel in the tubular member.

4. The pool brush of claim 3 wherein the elongated handle includes a resilient button configured to removably engage an opening in the tubular member.

5. The pool brush of claim 2 wherein the bottom plate of the handle receiver is attached to the top side of the cylindrical portion of the body.

6. The pool brush of claim 5 wherein the top side of the cylindrical portion of the body includes a recess configured to a shape of the bottom plate and into which the bottom plate is mounted.

7. The pool brush of claim 1 wherein the end portions are round.

8. The pool brush of claim 1 wherein the end portions are hemispherical or conical.

9. The pool brush of claim 1 wherein the arrays of the bundles of longer bristles and the arrays of the bundles of shorter bristles are each arranged in at least one row disposed circumferentially around the cylindrical portion of the body.

10. The pool brush of claim 1 wherein the arrays of the bundles of longer bristles and the arrays of the bundles of shorter bristles are each arranged in from 2 to 4 rows disposed circumferentially around the cylindrical portion of the body.

11. The pool brush of claim 1 wherein the longer bristles are relatively softer and the shorter bristles are relatively harder.

12. The pool brush of claim 1 wherein the shorter bristles are relatively softer and the longer bristles are relatively harder.

13. The pool brush of claim 1 wherein the shorter bristles have a length $L_1$ and the longer bristles have a length $L_2$, wherein the ratio $L_2/L_1$ ranges from about 1.05 to about 1.5.

14. The pool brush of claim 13 wherein the ratio $L_2/L_1$ ranges from about 1.1 to about 1.3.

15. The pool brush of claim 1 wherein the bristles are fabricated from nylon or polybutylene terephthalate.

16. The pool brush of claim 1 wherein the body has a length ranging from 6 inches to 30 inches.

17. The pool brush of claim 1 wherein the body has a diameter ranging from approximately 1 to 3 inches.

18. The pool brush of claim 1 wherein the alternating arrangement of the bundles of relatively longer bristles with arrays of the bundles of shorter bristles is as seen from a front view of the pool brush.

* * * * *